US008439772B2

(12) United States Patent
Heffron et al.

(10) Patent No.: US 8,439,772 B2
(45) Date of Patent: May 14, 2013

(54) FOOTBALL TRAINING DEVICE SYSTEM

(76) Inventors: Daniel J. Heffron, Leon, IA (US); Damon D. Boyd, Leon, IA (US)

( * ) Notice: Subject to any disclaimer, the term of this patent is extended or adjusted under 35 U.S.C. 154(b) by 14 days.

(21) Appl. No.: 13/167,069

(22) Filed: Jun. 23, 2011

(65) Prior Publication Data

US 2011/0319202 A1 Dec. 29, 2011

Related U.S. Application Data

(60) Provisional application No. 61/358,193, filed on Jun. 24, 2010.

(51) Int. Cl.
*A63B 69/00* (2006.01)

(52) U.S. Cl.
USPC ..... 473/438; 473/422; 473/458

(58) Field of Classification Search ..... 473/422, 473/423–425, 438, 450, 458, 464
See application file for complete search history.

(56) References Cited

U.S. PATENT DOCUMENTS

| | | | | | |
|---|---|---|---|---|---|
| 446,535 | A * | 2/1891 | Outbridge | 446/490 |
| 3,168,312 | A * | 2/1965 | Davis | 473/423 |
| 3,382,609 | A * | 5/1968 | Neanhouse | 446/484 |
| 3,804,409 | A * | 4/1974 | Schachner | 473/423 |
| 4,145,046 | A * | 3/1979 | Jones | 473/424 |
| 4,278,257 | A * | 7/1981 | Garcia et al. | 473/423 |
| 4,526,374 | A * | 7/1985 | Ban | 473/231 |
| 4,601,474 | A * | 7/1986 | Lew et al. | 473/576 |
| 4,753,442 | A * | 6/1988 | Bland | 473/424 |
| 5,080,376 | A * | 1/1992 | Lerner et al. | 473/424 |
| 5,083,797 | A * | 1/1992 | Vartija et al. | 473/424 |
| 5,401,034 | A * | 3/1995 | Mallinger | 473/576 |
| 5,415,396 | A * | 5/1995 | Huang | 473/417 |
| 5,586,760 | A * | 12/1996 | Hauter | 473/424 |
| 5,660,550 | A * | 8/1997 | Roche | 473/427 |
| 5,669,837 | A * | 9/1997 | Hauter | 473/576 |
| 5,772,542 | A * | 6/1998 | Gildea et al. | 473/576 |
| 5,810,685 | A * | 9/1998 | Willner et al. | 473/571 |
| 5,853,334 | A * | 12/1998 | Winebrenner | 473/142 |
| 5,853,339 | A * | 12/1998 | Scerbo | 473/576 |
| 5,957,788 | A * | 9/1999 | Eze | 473/422 |
| 7,195,534 | B1 * | 3/2007 | Millman | 446/26 |
| 7,273,428 | B2 * | 9/2007 | James | 473/431 |
| 7,435,193 | B2 * | 10/2008 | Johnson et al. | 473/423 |

* cited by examiner

*Primary Examiner* — Mitra Aryanpour
(74) *Attorney, Agent, or Firm* — Zarley Law Firm, P.L.C.

(57) ABSTRACT

A football training device and system is presented that simulates game-time conditions wherein players of the opposite team attempt to strip the ball carrier of the ball. The football training device has a football with at least one cord attached to each end of the football. The cord is connected to a housing which is attached to the player's body by a strap. As the player carries the football a remote control device is used to activate the housing to retract the cord which acts to strip the football from the players hands.

18 Claims, 2 Drawing Sheets

FOOTBALL TRAINING DEVICE SYSTEM

CROSS REFERENCE TO A RELATED APPLICATION

This application claims the benefit of U.S. Provisional Application No. 61/358,193 filed Jun. 24, 2010.

BACKGROUND OF THE INVENTION

This invention is directed toward a training device. More specifically, and without limitation, this invention is directed toward a training device for football.

In the game of football reducing and/or eliminating fumbles is desirable. To achieve this, various methods and devices have been employed to simulate game conditions. These methods involve having other players attempt to strip the ball from the ball carrier or having the ball carrier run through a device where he encounters various moving obstacles designed to dislodge the ball from his arms. While helpful, these methods and devices either require other individuals to operate the device or cannot be used remotely. Therefore, a need exists in the art for a device that addresses these needs.

Accordingly, an object of the invention is to simulate game-time conditions wherein players of the opposite team attempt to strip the football.

Another object of the invention is to provide a training device which helps train players how to prevent fumbles.

These and other objects, features and advantages will become apparent from the specification and the claims.

BRIEF SUMMARY OF THE INVENTION

A football training device and system is presented that simulates game-time conditions wherein players of the opposite team attempt to strip the ball carrier of the ball. The football training device has a football with at least one cord attached to each end of the football. The cord is connected to a housing which is attached to the player's body by a strap. As the player carries the football a remote control device is used to activate the housing to retract the cord which acts to strip the football from the players hands.

DETAILED DESCRIPTION OF THE INVENTION

Figure 1:
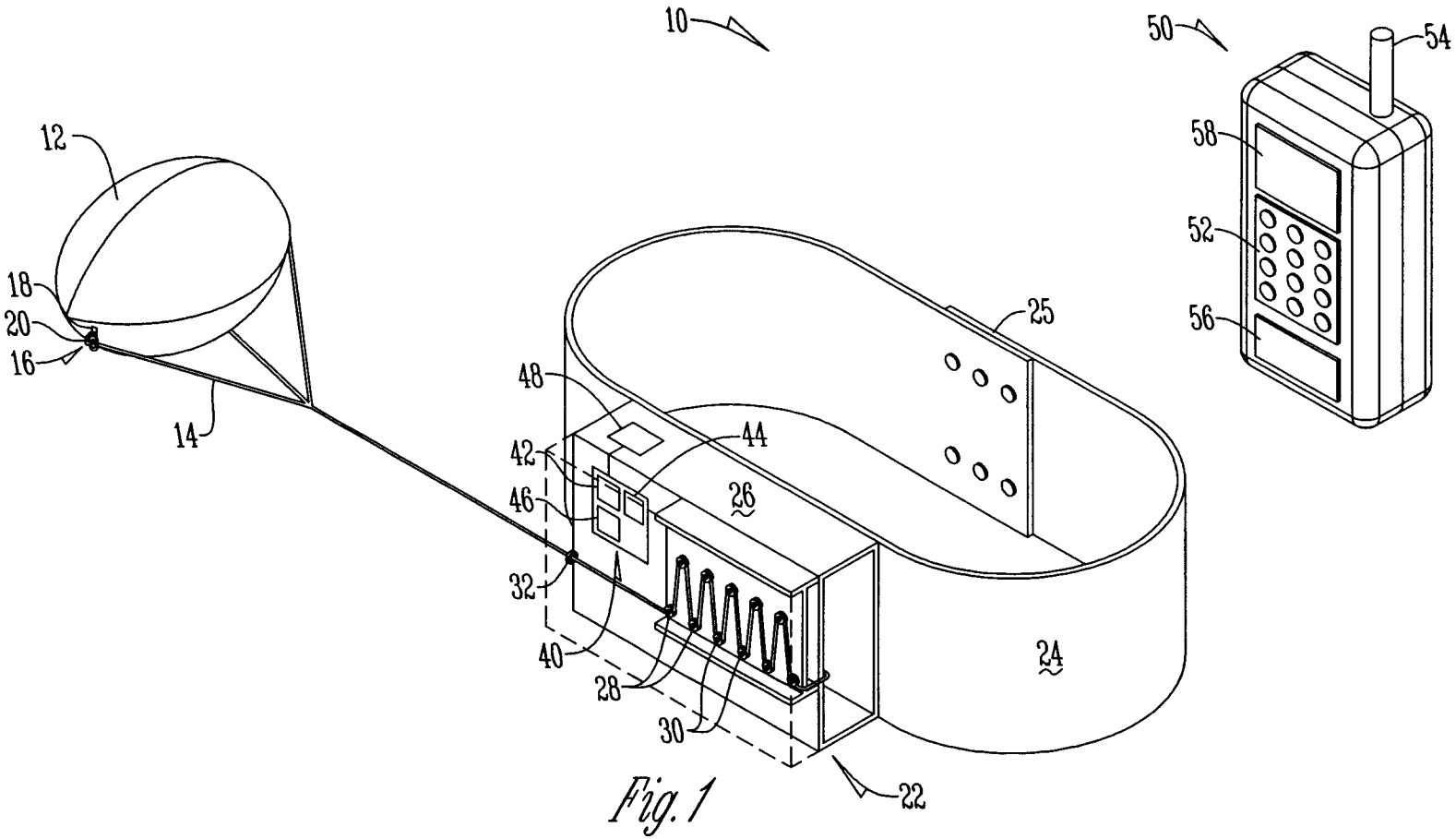
FIG. 1 is a perspective view of the training device system.
Figure 2:
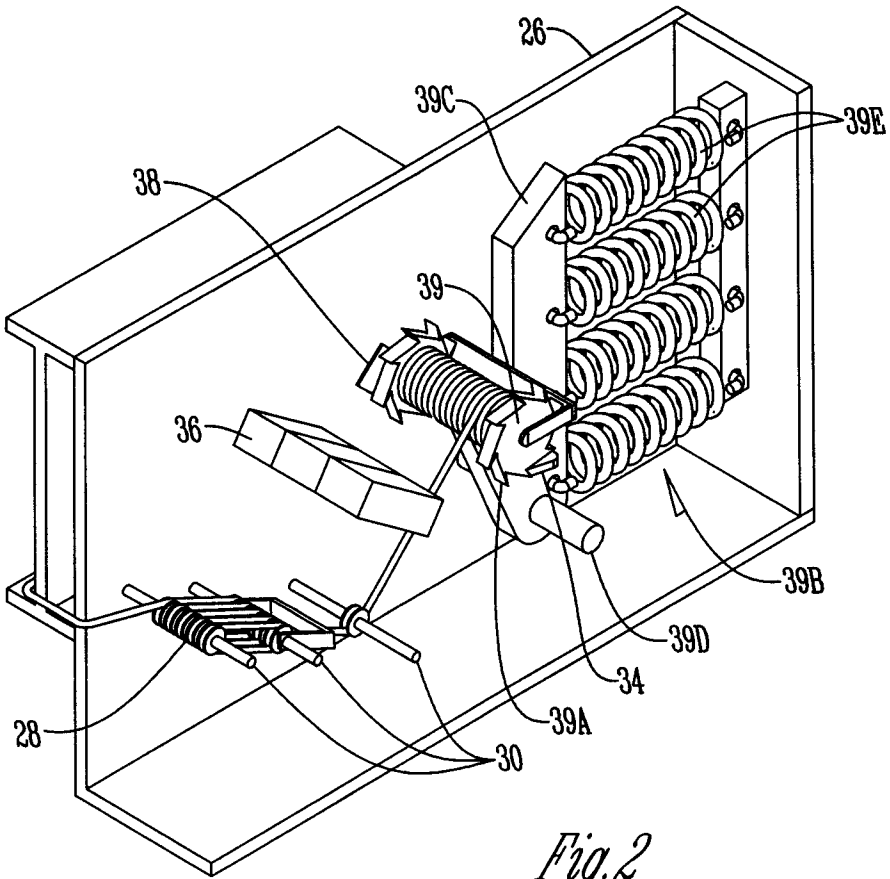
FIG. 2 is a perspective cut-away view of the housing of the training device system.

Referring to the Figures, a training device system 10 includes a football 12 with a pair of cords 14 attached to each end of the football 12. The cords 14 are attached in any conventional manner and preferably include a fastening member 16 having a butterfly member 18 with an extending O-ring 20 sewn or glued to each end of the football 12. The cord 14 is of any material and preferably is made of nylon.

The opposite ends of the cords 14 are retractably attached to a recoil member 22. In its simplest form the cords 14 are bungee cords attached to the recoil member 22 where constant tension is applied to the ends of the football 12. In this arrangement, recoil member 22 is attached to an attachment member 24 such as a strap having a an adjustable fastening member 25, a belt, a backpack, a clip or any other device which attaches football 10 to the player's body or an article of the player's clothing so as to provide a position from which tension is generated. Alternatively, attachment member 24 is connected to a static position, such as the ground through the use of a stake or other member, or to a static object such as a goal post, vehicle, another player, a blocking instrument, or any other object. After attaching or mounting the attachment member 24, the length of the cords 14 are adjusted using the recoil member 22 such that there is tension on the football 12 when held in the players hands.

In another embodiment the recoil member 22 includes a housing 26 with a pair or plurality of spring loaded pulleys 28 rotatably mounted on one or more shafts 30. The cords extend through one or more openings 32 in the housing 26 with the cords 14 connected to separate pulleys 28 or a plurality of pulleys 28. In one arrangement the cords 14 mounted to each end of the football 12 are connected together outside of housing 26 such that only one cord is retracted by housing 26. Alternatively, in another arrangement, cords 14 are connected to each end of the football 12 and each cord 14 enters into housing 26 individually, and therefore each end of the football is controlled individually by housing 26. Alternatively, a cord 14 is connected to each end of the football 12 and each cord has its own dedicated housing 26.

Mounted within the housing 26 is at least one stop 34 that limits movement of the pulleys 28 and at least one sensor 36. Also, one or more activators 38 are attached to the pulleys 28 or the shafts 30 to selectively and independently activate the pulleys 28. Rotatably mounted within housing 26 is spool 39 upon which cord 14 is wound. Spool 39 has gear teeth 39A at its peripheral edges so as to effectuate, stop and control spooling of cord 14 thereon. Spool 39 is mounted to a tension member 39B having a articulating arm 39C rotatably mounted on a pivot point 39D. A plurality of tension springs 39E connect articulating arm 39C to the housing 26. This arrangement allows for some give in the system when tension is applied to football 12 as the tension springs 39E will extend and retract allowing articulating arm 39C to rotate upon pivot point 39D thereby affecting the length of cord 14 allowed to exit housing 26.

Attached to either the attachment member 24 or the housing 26 is a controller 40 that is in electronic communication with the activators 38 and sensors 36. The controller 40 has a transmitter 42, a receiver 44, a processor 46, and a display 48. A remote control device 50 having an input member 52, transmitter 54, receiver 56, and display 58 is in wireless communication with the controller 40.

In operation, the recoil member 22 is attached to the football carrying player using the attachment member 24, such as a strap or belt around the player's waist, and fastening member 25, such as VELCRO® or a buckle, such that the football 12 is held in the ball carrying player's arm(s) with some tension on the cords 14. The length of the cords 14 can be adjusted in this position to adjust the amount of initial tension on the football 12. Using the remote control device 50 one, both or a plurality of the pulleys 28 are activated to increase the load on one or more of the cords 14. Activation occurs by inputting a command using the input member 52 of the remote control device 50 and sending a signal from the remote control device 50 to the controller 40 of the housing. The controller 40 receives the signal and sends a signal to the activators 38 which in turn rotate the pulleys 28, and/or spool 39 adding load to the cords 14. The sensors 36 monitor either the rotation of the pulley(s) 28 or the distance traveled by the cord(s) 14 and sends a signal to the controller 40. The controller 40 stores the sensed information in its memory and displays the stored information on display 48. Alternatively the processor 46, using the received information calculates whether a fumble occurs. This information is likewise stored and/or displayed on display 48. All information is also transmitted to the remote control device 50 where it is also stored and displayed on the display 58.

From the above discussion it will be appreciated that provided is a football training device that provides a new, useful and nonobvious apparatus and means of simulating football game conditions wherein players attempt to strip the ball from the ball carrier. Accordingly, the apparatus and means presented herein is an improvement and offers many advantages over the prior art. It will be appreciated by those of ordinary skill in the art that other various modifications could be made to the device without parting from the spirit and scope of this invention. All such modifications and changes fall within the scope of the claims and are intended to be covered thereby.

We claim:

1. A football training device comprising:

a football having at least one cord connected to the football;

a housing connected to an attachment member;

the cord retractably extending between the football and the housing;

the attachment member connected to a body of the player;

a remote control device wirelessly connected to the housing; and wherein when the player carries the football the housing retracts the cord thereby simulating a strip.

2. The football training device of claim 1 wherein retraction of the cord is activated by a remote control device.

3. The football training device of claim 1 further comprising a sensor electrically connected to the housing which senses whether a fumble occurs.

4. The football training device of claim 1 further comprising a display connected to the housing.

5. The football training device of claim 1 further comprising at least one pulley connected to the cord to effectuate retraction.

6. The football training device of claim 1 further comprising a spool connected to the housing to effectuate retraction.

7. The football training device of claim 1 further comprising a tension member that provides some give to the cord.

8. A method of using a football training device comprising the steps of:

providing a football training device having a football connected to a housing by at least one cord;

connecting the housing to the body of a player by an attachment member;

holding the football by the player;

activating the housing such that the housing retracts the cord such that a strip is simulated; and wherein the housing is activated by way of a remote control wirelessly connected to the housing.

9. The method of claim 7 wherein the cord is connected to at least one pulley within the housing.

10. The method of claim 7 wherein the cord is wound around a spool within the housing.

11. The football training device of claim 1 wherein the attachment member is a belt.

12. A football training device comprising:

a football having at least one cord connected to the football;

a housing connected to an attachment member;

the cord retractably extending between the football and the housing;

the attachment member connected to a body of the player; and a recoil member connected to the housing having at least one pulley such that when activated when the player carries the football the housing retracts the cord thereby simulating a strip.

13. The football training device of claim 12 wherein retraction of the cord is activated by a remote control device.

14. The football training device of claim 12 further comprising a sensor electrically connected to the housing which senses whether a fumble occurs.

15. The football training device of claim 12 further comprising a display connected to the housing.

16. The football training device of claim 12 further comprising a spool connected to the housing to effectuate retraction.

17. The football training device of claim 12 further comprising a tension member that provides some give to the cord.

18. The football training device of claim 12 wherein the attachment member is a belt.

* * * * *